US008082766B1

(12) United States Patent
Black

(10) Patent No.: US 8,082,766 B1
(45) Date of Patent: Dec. 27, 2011

(54) PIN TUMBLER LOCK RELEASING SYSTEM

(76) Inventor: Carl Black, Overland Park, KS (US)

( * ) Notice: Subject to any disclaimer, the term of this patent is extended or adjusted under 35 U.S.C. 154(b) by 0 days.

(21) Appl. No.: 13/195,474

(22) Filed: Aug. 1, 2011

Related U.S. Application Data

(62) Division of application No. 12/616,698, filed on Nov. 11, 2009, now Pat. No. 8,001,816.

(51) Int. Cl.
*E05B 19/20* (2006.01)
*E05B 27/04* (2006.01)

(52) U.S. Cl. ..... 70/394; 70/395; 70/492

(58) Field of Classification Search ..... 70/394, 70/337–343, 382–385, 492–93, 495–96, 70/400, 401, 395, 399; 33/540; 81/15.9
See application file for complete search history.

(56) References Cited

U.S. PATENT DOCUMENTS 4,667,494 A * 5/1987 Joosten ..... 70/394
6,148,652 A * 11/2000 Magini et al. ..... 70/394
7,434,431 B2 * 10/2008 Armstrong et al. ..... 70/492

* cited by examiner

*Primary Examiner* — Kristina R. Fulton
(74) *Attorney, Agent, or Firm* — Invention Protection Associates, LLC

(57) ABSTRACT

A pin tumbler lock releasing system includes keyway insertible and universally configured lift, key and shim devices that are cooperatively used to raise the pin stacks within a pin tumbler lock to just above the pin tumbler lock's shear line so that the lock's plug element may be rotated within its outer casing in order to disengage its locking mechanism.

9 Claims, 9 Drawing Sheets

PIN TUMBLER LOCK RELEASING SYSTEM

This application is a divisional that claims the benefit of application Ser. No. 16/616,698 filed Nov. 11, 2009. Furthermore, application Ser. No. 16/616,698 is hereby incorporated by reference.

BACKGROUND OF THE INVENTION

Pin tumbler locks generally feature four primary components: an outer casing, a plug, a locking mechanism and a series of parallel pin stacks. Formed through the casing is a cylindrical bore within which the cylindrical plug is rotatably housed. Opening at the front end of the plug is a slot, or "keyway," that extends axially into it and is configured to receive a key having a specific cut. At the rear end of the keyway typically is a lever or cam arrangement that actuates the locking mechanism to engage or release the lock upon relative rotation of the plug and casing. Formed within both the casing and plug is a parallel series of aligned holes (typically, four to six, but can be more or less) that open to the keyway and extend radially upward (when the keyway's front opening is vertically oriented) into the casing where their respective upper ends are closed. The plug and casing portions of these aligned holes meet along an imaginary plane line commonly referred to as the "shear line."

Within each aligned hole is a tumbler pin stack defined by a spring-loaded "driver pin" pressing downward against a sliding "key pin." When the keyway is empty (i.e., no key is within it) the bottom of each key pin rests along a short flange that juts into the keyway and runs transverse to the pin axis to prevent key pins sliding completely down into the keyway slot. The upper ends of the driver pins abut coil springs that force the driver pins, and therefore the key pins, down toward the keyway.

When no key is filling the keyway, either the driver pin or key pin within each pin stack straddles the shear line and thereby collectively prevent the plug from rotating within the casing. Moreover, because the key pins are not all uniform in length (the driver pins are), when a key that is not cut to operate with the specific lock at hand is inserted into the keyway, one or more of the key pins and/or driver pins will be positioned straddling the shear line. However, when the proper key is inserted, the flat top of each key pin will abut the bottom of its driver pin counterpart precisely at the shear line boundary between the plug and casing. This precise alignment of the pin contact surfaces with the shear line renders the pin stacks ineffective in inhibiting plug rotation so that the locking mechanism can be released by delivering torque to the plug via the key.

in situations in which a pin tumbler lock must be opened, but a properly cut key is not available to the lock owner, the owner or a locksmith will likely be forced to either destroy the lock or employ a lock "picking" or "bumping" technique in order to open a lock. Generally speaking, lock picking involves manipulation of all the existent pin stacks, in one-by-one sequence, until they are all aligned with the shear line so as to permit plug rotation. A variety of devices, ranging from crude took to more sophisticated instruments have been recognized as effective in picking pin tumbler and other types of locks. In contrast, lock bumping is a technique practiced exclusively on pin tumbler locks. Bumping basically involves utilization of a specially cut key to impart to the key pins and, in turn, to the driver pins an impact force that causes each driver pin and key pin pairing to momentarily separate such that all of the driver pins are elevated entirely above the shear line, while all key pins remain entirely below it. Bumping further requires that a rotational force be applied to the plug during that extremely brief moment of pin stack displacement.

That the present inventor is aware, all prior art devices known to be effective in opening pin tumbler type locks, be they picking devices or bumping devices, are designed to manipulate the pin stacks such that each driver pin ends up being disposed entirely within a lock's outer casing while each key pin is disposed entirely within its plug. Depending on the sophistication of the particular tools used, lock picking can be a tedious proposition simply due to the incremental manner in which each pin stack must be properly aligned with the shear line before the locking mechanism can be released. Lock bumping can also be difficult due to the delicateness and precise timing that may be needed in applying to the key pins an impact force of appropriate magnitude and direction to cause the desired separations of the key pins and driver pins about the shear line while also initiating plug rotation during the fleeting moment in which the pins are so displaced. Consequently, it can be appreciated that there exists a need for a new technique for opening pin tumbler locks that represents an alternative to known picking and bumping techniques, and there is a concomitant need for tools that would enable a user to practice such a technique without having acquired any particular expertise or exhibiting any particular skill. The present inventor submits that the present system of tools and his conceived method for using them on a pin tumbler lock substantially fulfill these outstanding needs.

SUMMARY OF THE INVENTION

The present invention generally relates to non-destructive lock picking, and it is specifically directed to a system of tools used for releasing a lock of the "pin tumbler" type in a novel fashion that neither damages the lock nor requires use of a typical lock key.

It is an object of the present invention to provide tools for actuating release of any lock that employs a pin tumbler mechanism without the intended key.

It is an associated object of the present invention to provide at least one combination of tools that a person possessing no adeptness whatsoever at lock picking can easily use to practice the instant lock releasing method.

one aspect of the invention, pin tumbler locks are opened in a manner that is quite unconventional in the respect that it does not involve an aligning of driver and key pin contact surfaces with the imaginary shear line between the plug and outer casing elements of a pin tumbler lock, hut rather involves using a system of tools to press key pins beyond the plug's periphery and entirely into the outer casing, along with their abutting driver pins, so that the bottoms, not the tops, of the key pins become coplanar with the shear line. In distinguishing it from well-known picking and bumping techniques, the present inventor has coined the term "jamming" (as entire pin stacks are essentially "jammed" above the shear line) in reference to the pin tumbler lock releasing technique performed using the system of the present invention.

In another aspect of the invention, the aforedescribed jamming technique can be manually implemented using, combination, two, three, or four devices which include (1) a pin stack lifting tool, (2) a key having a uniformly toothed blade, (3) a shim for providing underlying support for the key, and (4) a common torque wrench to aid in turning a lock plug.

Preferably, the lift device comprises a handle as well as a blade that can be inserted into an upper portion of most pin tumbler lock keyways. The key device similarly comprises a handle and a blade that has the same vertical profile as that of the lift blade. However, along the key blade is a series of uniformly spaced teeth that are adapted to fit into the vertical holes formed within the lock plug (those in which pin stacks reside). The respective thicknesses of the blade portions of the lift and key devices are such that both blades snugly fit side-by-side into the keyway. The shim device also comprises a handle and blade, and it is configured so that its blade can be wedged underneath the key blade in order that the key teeth push the key pin bottoms up into alignment with the shear line. Finally, in some embodiments of the present invention, a torque wrench can be inserted into the keyway next to the shim device to provide the user a moment arm for transmitting torque that rotates the plug and disengages the lock.

It should be noted that the term "blade," as it is used throughout this disclosure, generally denotes a portion of the pertinent instrument that is relatively elongate and is adapted to be inserted into a typical keyway, but does not necessarily imply anything regarding the contour or sharpness of the edge(s) of that portion nor any other of its structural aspects.

DETAILED DESCRIPTION OF THE PREFERRED EMBODIMENTS

Figure 1:
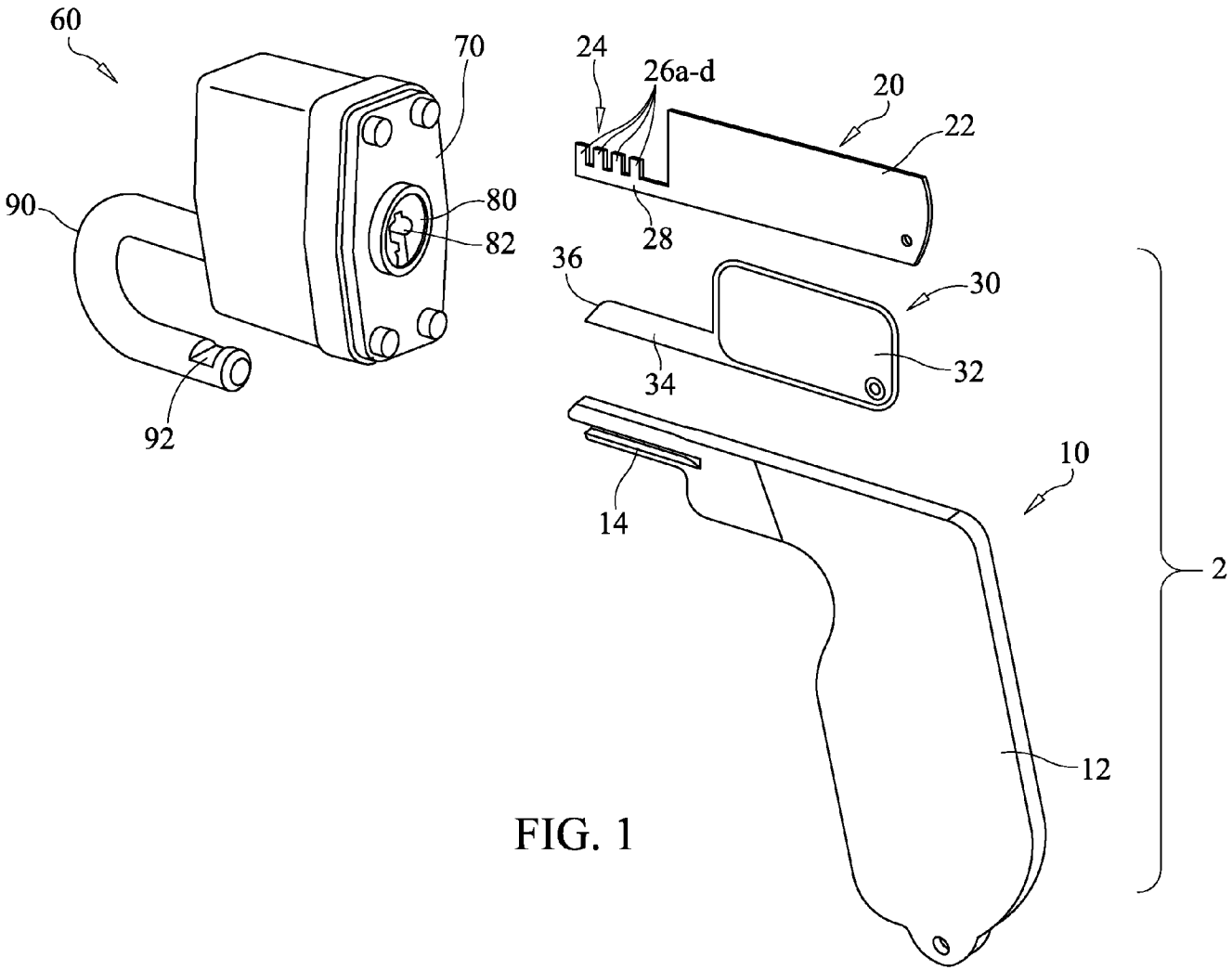
FIG. 1 is a side perspective view of a key, lift device and shim of the preferred embodiment of the pin tumbler lock releasing system of the present invention, the view showing all three instruments distanced from a pin tumbler lock that is in a lock released state.

This disclosure, as defined by the claims that follow and as illustrated, by way of example, in the accompanying drawings, relates to an apparatus system and method for releasing pin tumbler-type locks. Most of the accompanying drawings depict the system being used on a pin tumbler padlock 60. This particular lock 60 comprises a cylindrical plug 80 disposed within an outer casing 70. The lock 60 has a keyway 82 and four pin stacks that each comprise a driver pin 68 and a key pin 64 disposed within aligned vertical apertures, or "tumbler pin holes," formed within both its plug 80 and casing 70. Coil springs 68 are mounted to both the closed top ends of the pin holes and the driver pins 68 to bias both pins 68, 64 downward. The lock 60 also features a locking mechanism comprising a pair of oppositely oriented cams 96, 98 that pivot, upon rotation of the plug 80, to lock and release a spring-loaded shackle 90. Nevertheless, pin tumbler locks adapted for use with dwelling doors (interior and exterior), vehicles, etc, may be operated upon using the present system in the present manner.

It should be understood that the presently disclosed lock releasing system has utility in the opening of pin tumbler locks generally, and its relevance is not limited to pin tumbler-type locks of the particular configuration depicted in the accompanying drawings and described above and throughout this disclosure. In fact, the present system is compatible with a plethora of pin tumbler locks of varying features, such as differences in total numbers of tumbler pin stacks, in number of pins within individual stacks (e.g., some pin tumbler locks may include an additional "spacer" pin(s) situated between each driver pin and key pin) and in the configurations of their locking mechanisms. Of course, certain specifications of the instruments employed in the present invention may need to be varied accordingly.

FIG. 1 illustrates a preferred embodiment of the lock releasing system of the present invention. That preferred embodiment is a three-piece system 2 comprising a key 20, a lift device 30 and a shim 10 that all operate with the shown pin tumbler lock 60. The key 20 comprises a handle portion 22 and an insert portion 24, or blade. The key blade 24, itself, comprises a rectangularly elongated base 28 that has multiple teeth 26 projecting upward from it. The number of teeth included on the key blade 24 can differ, as any given system key 20 will properly operate with only locks that feature the same number of tumbler pin stacks as the number of teeth 26 along that key 20. So, for example, since the lock 60 shown in cross-section in FIGS. 2-4 has four pin stacks, a suitable system key 20 will feature four teeth 26*a-d*. Furthermore, the height of the uniformly profiled key teeth 26*a-d*, as measured from troughs between teeth 26 (i.e., top borders of the key blade's base 28), must be exactly equal to the length of the plug segment of a tumbler pinhole.

Figure 6:
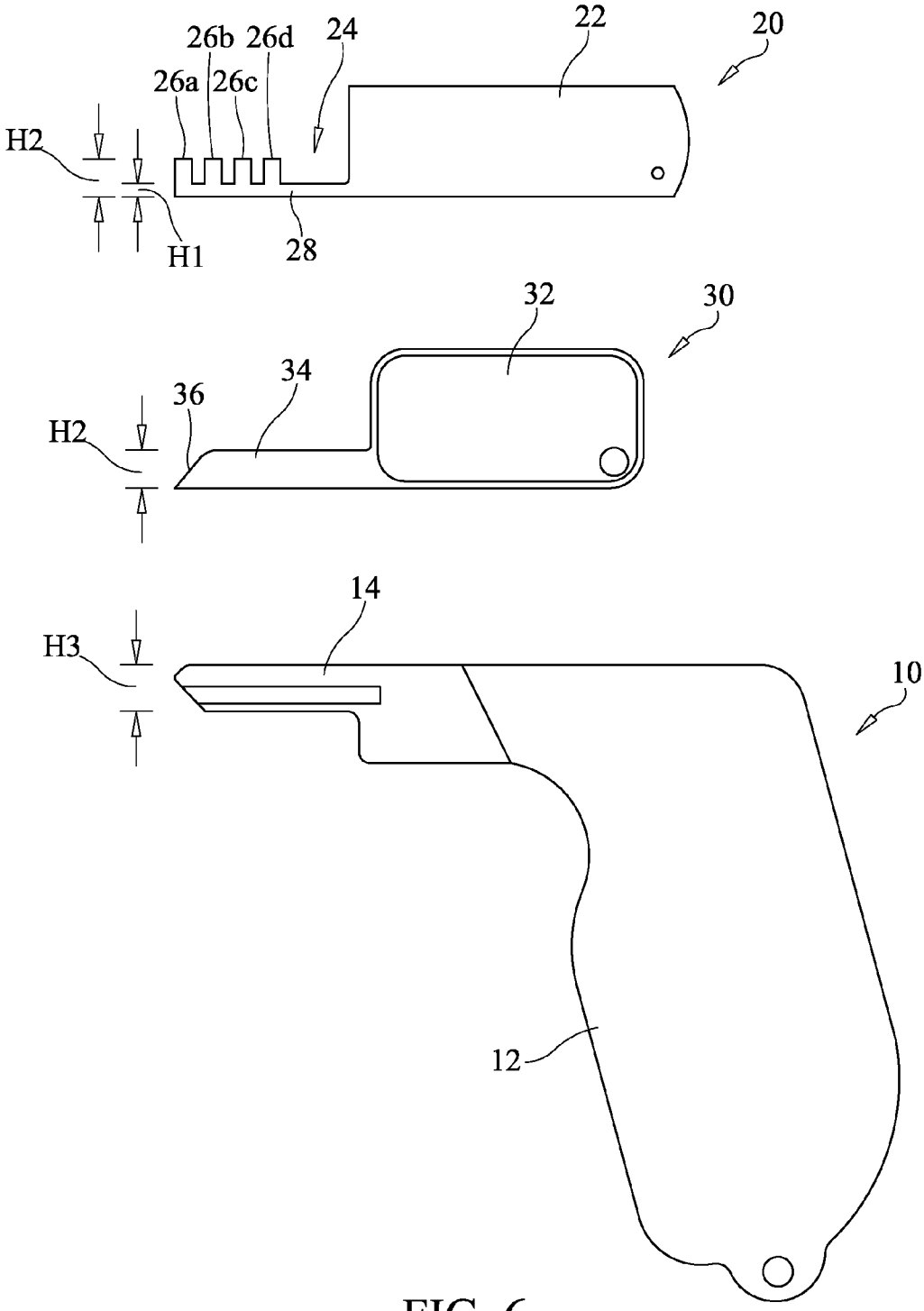
FIG. 6 is a side elevational view of the key, lift device and shim of the preferred system.

The lift device 30 also comprises a handle 32 and a blade 34. As shown in FIG. 6, the lift blade 34 features an arcuately beveled leading edge 36, and it has the same vertical height H2 as does the key blade 24. This enables the lift blade 34 to slide under and raise key pins 64 that are protruding down into the keyway 82, as it escorts the key blade 24 into the keyway. The key blade 24, if unaccompanied by the lift blade 32, might not smoothly insert into the uppermost portion of the keyway 82 because of tooth jaggedness issues. Finally, the shim 10 also comprises a handle 12 and blade 14. The shim blade 14 may be grooved to conform to a lower portion of a typical keyway.

Figure 2:
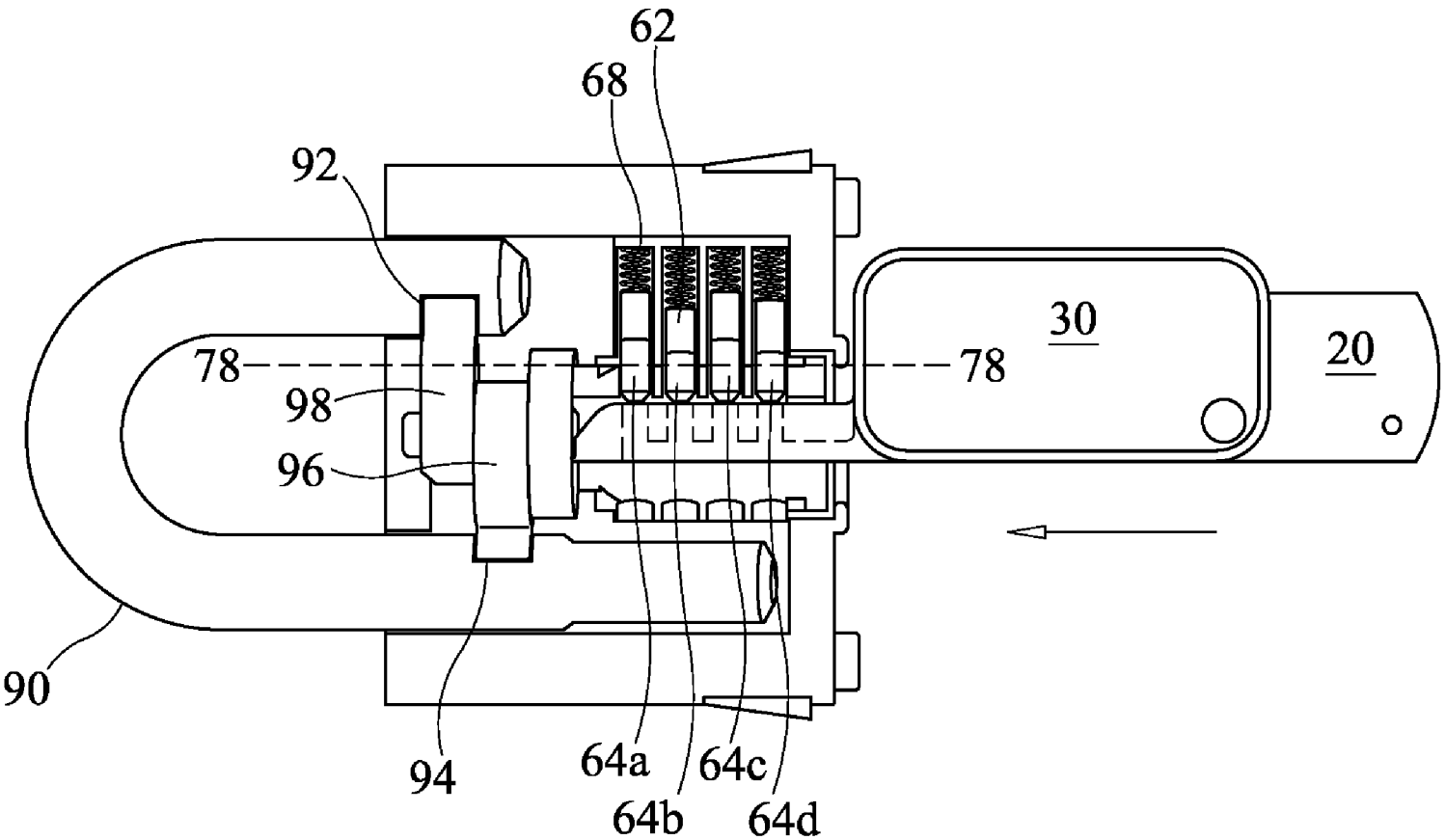
FIG. 2 is a side elevational view of the key and lift device of the preferred system, the view showing both instruments fully inserted into the lock, shown in cross-section, while it is in a locked state.
Figure 3:
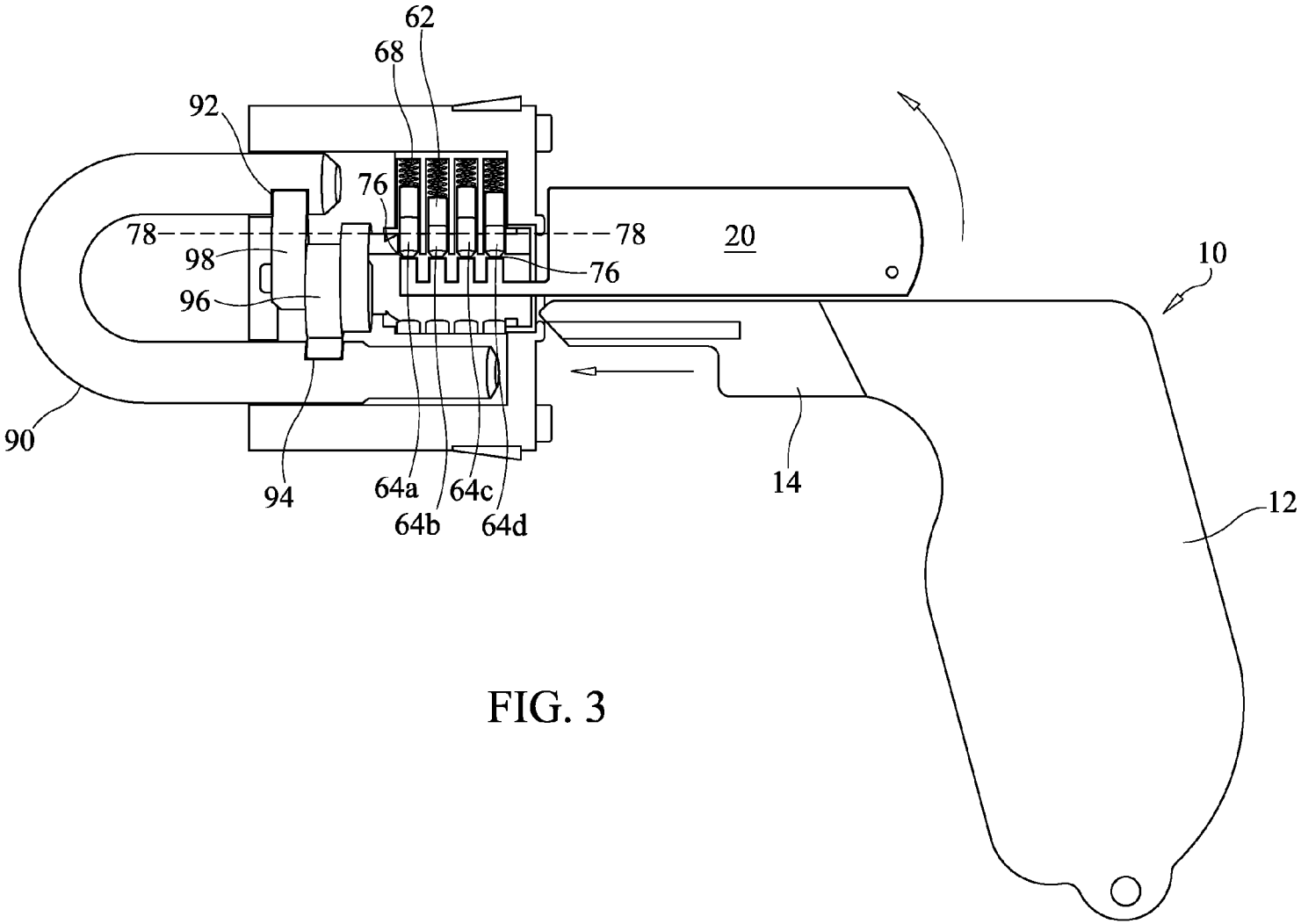
FIG. 3 is a side elevational view of the key and shim of the preferred system, the view showing the key fully inserted into the lock and the shim approaching the lock's keyway (with the key handle being motioned upward in order to accommodate shim insertion) while the lock, shown in cross-section, is in a locked state.

The first step of the preferred "jamming" method of the present invention involves simultaneously inserting the key 20 and lift device 30 into an upper portion of the keyway 82, as shown in FIG. 2. Again, the lift blade 34 slightly raises the all four key pins 64*a-d* upward against their spring biases and provides clearance for the key blade 24. Once fully inserted, each of the four key blade teeth 26*a-d* are aligned and in contact with one of the four key pins 64*a-d*, and the key pins 64*a-d* will generally be positioned partly within the plug 80 and partly within the outer casing 70 such that they straddle the lock's shear line 78. Thus, the plug 80 and casing 70 remain held in fixed relation. As a next step, the lift device 30 can be withdrawn from the keyway 82 while the key 20 is steadily held in place.

Theoretically, the key 20 can then be carefully raised, without its handle 22 being rocked upward or downward, in order to press the key pins 64*a-d* in alignment with the shear line 78. However, because that would require a user to manually exert precisely constant and identical upward pressure on every key pin 64*a-d* while simultaneously attempting to revolve the key handle 22 about an axis that is offset from the key handle's rotation axis, it is preferred that a shim device 10 be used as an underlying support for the key 20. Therefore, as a third step shown in FIG. 3, the blade 14 of the shim device 10 is slid into a lower portion of the keyway 82. Depending upon the configurations of the key handle 20 and shim handle 12, the key handle 20 may need to be momentarily rocked slightly upward to accommodate initial insertion of the shim blade 14.

Figure 4:
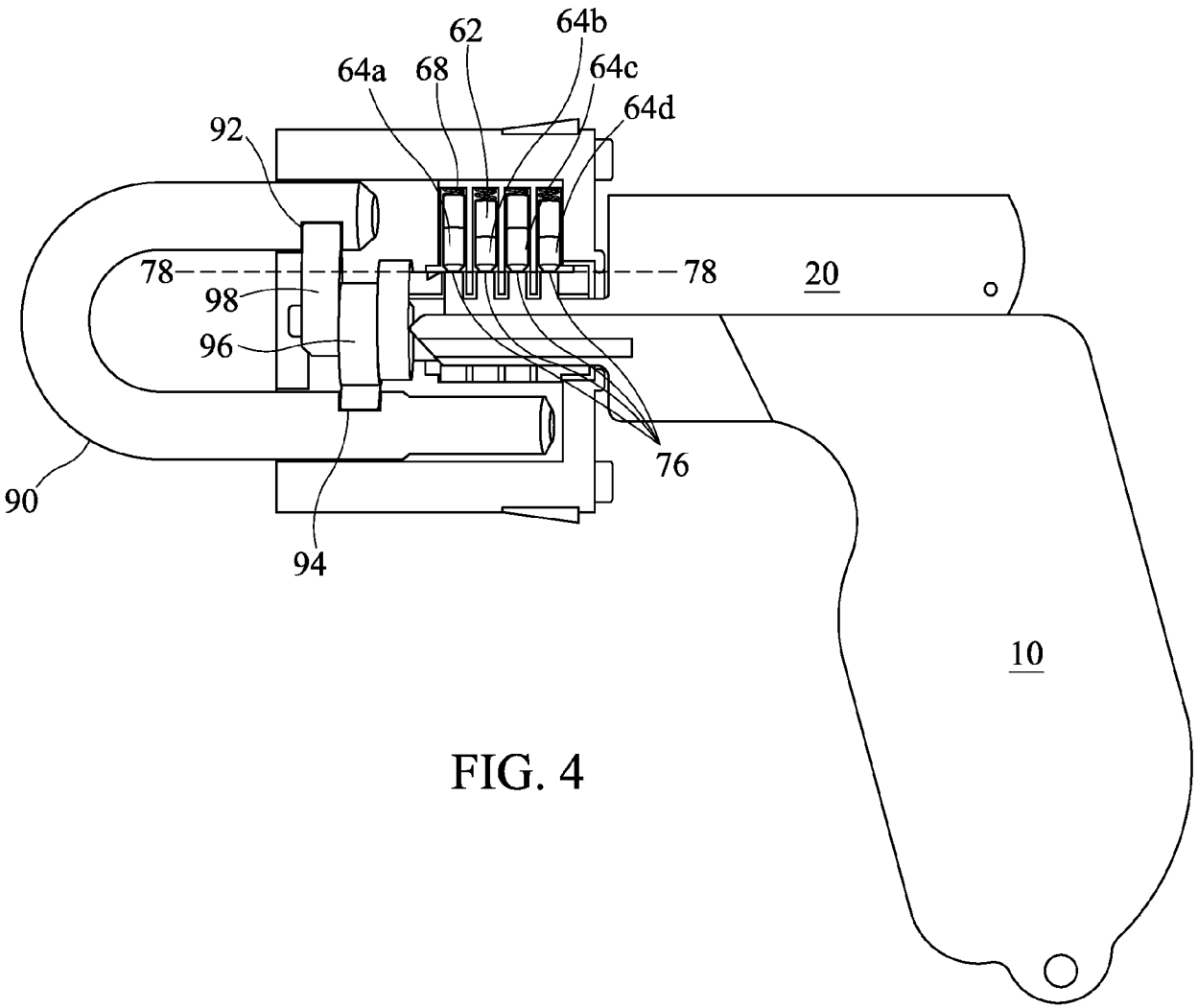
FIG. 4 is a side elevational view of the key and shim of the preferred system, the view showing both instruments fully inserted into the lock, shown in cross-section, while it is in a locked state.

Because the sum of the height H1 of the key blade base 20 and the height H3 of the shim blade 14 (see FIG. 6) is only very slightly less than the vertical width of the keyway 82 (giving them a slide clearance fit into the keyway 82), the shim blade's insertion presses the key teeth 26*a-d* into their corresponding pin tumbler holes as illustrated in FIG. 4. The shim's presence within the keyway 82 also stabilizes the key 20 and allows the user to manipulate only the shim handle 12 at this point. Moreover, because the key teeth 26*a-d* have height profiles equivalent to the lengths of the plug segments of the pin tumbler holes, as previously mentioned, the respective contact surfaces 76 between the key teeth 26*a-d* and the key pins 64*a-d* are elevated into alignment with the shear line 78, and the cylindrical plug 80 ceases to be inhibited from rotating about its axis. No prior art of which the present inventor is aware discloses devices configured to raise a pin tumbler lock's pin pairs to that precise position and maintain them there without requiring any notable degree of skill or hand steadiness.

Figure 5:
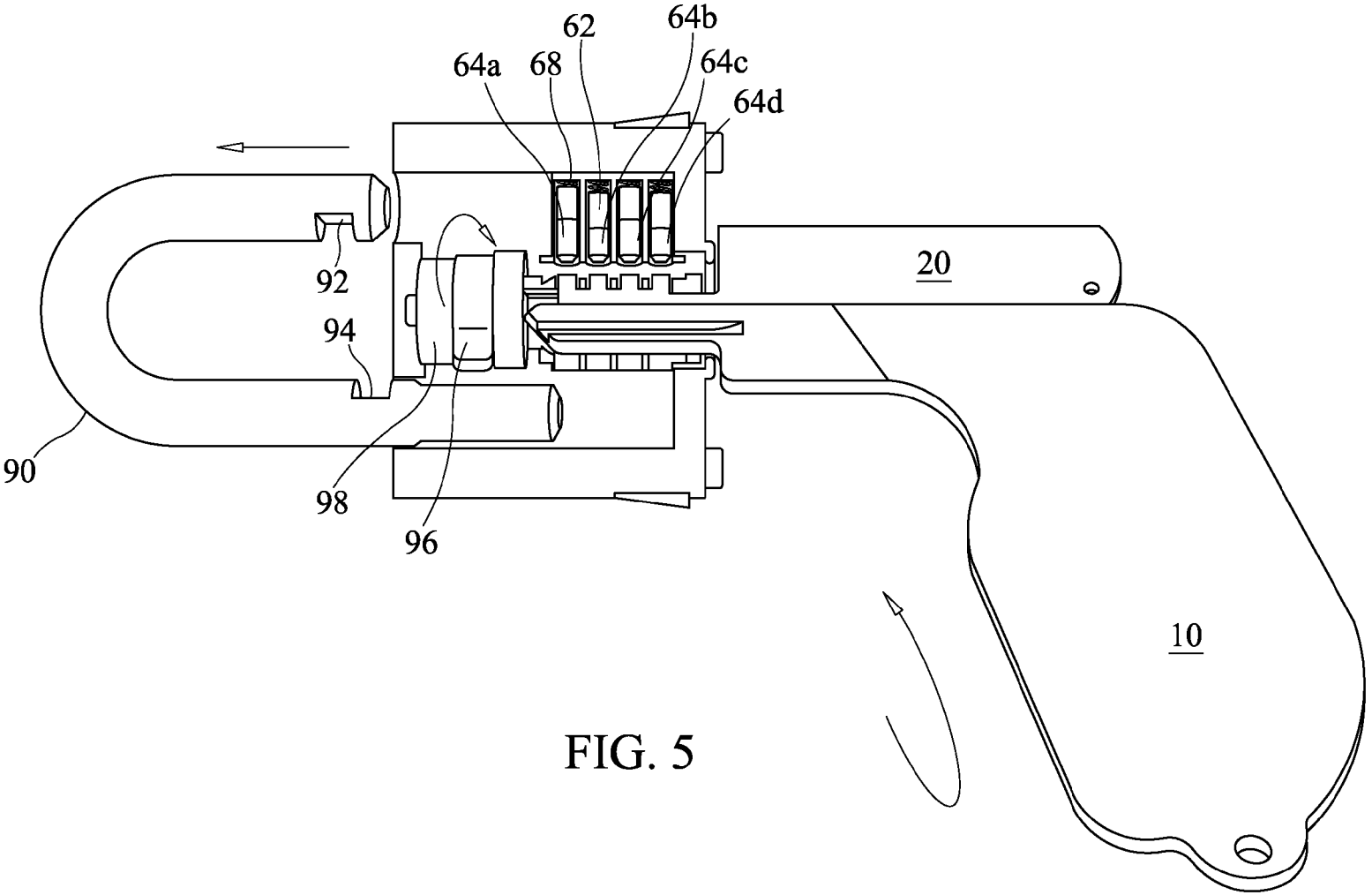
FIG. 5 is a side elevational view of the key and shim of the preferred system, the view showing both instruments fully inserted into the lock and being rotated clockwise, causing the lock, shown in cross-section, to release.

Finally, as a fourth step, the shim 10 is turned clockwise to transmit torque to the plug 80. As the plug 80 is then rotated, the cams 96, 98 also rotate and dislodge from conforming notches 94, 92 along the shackle 90. Consequently, one end of the spring-loaded shackle 90 releases from the casing 70 as shown in FIG. 5.

Figure 7:
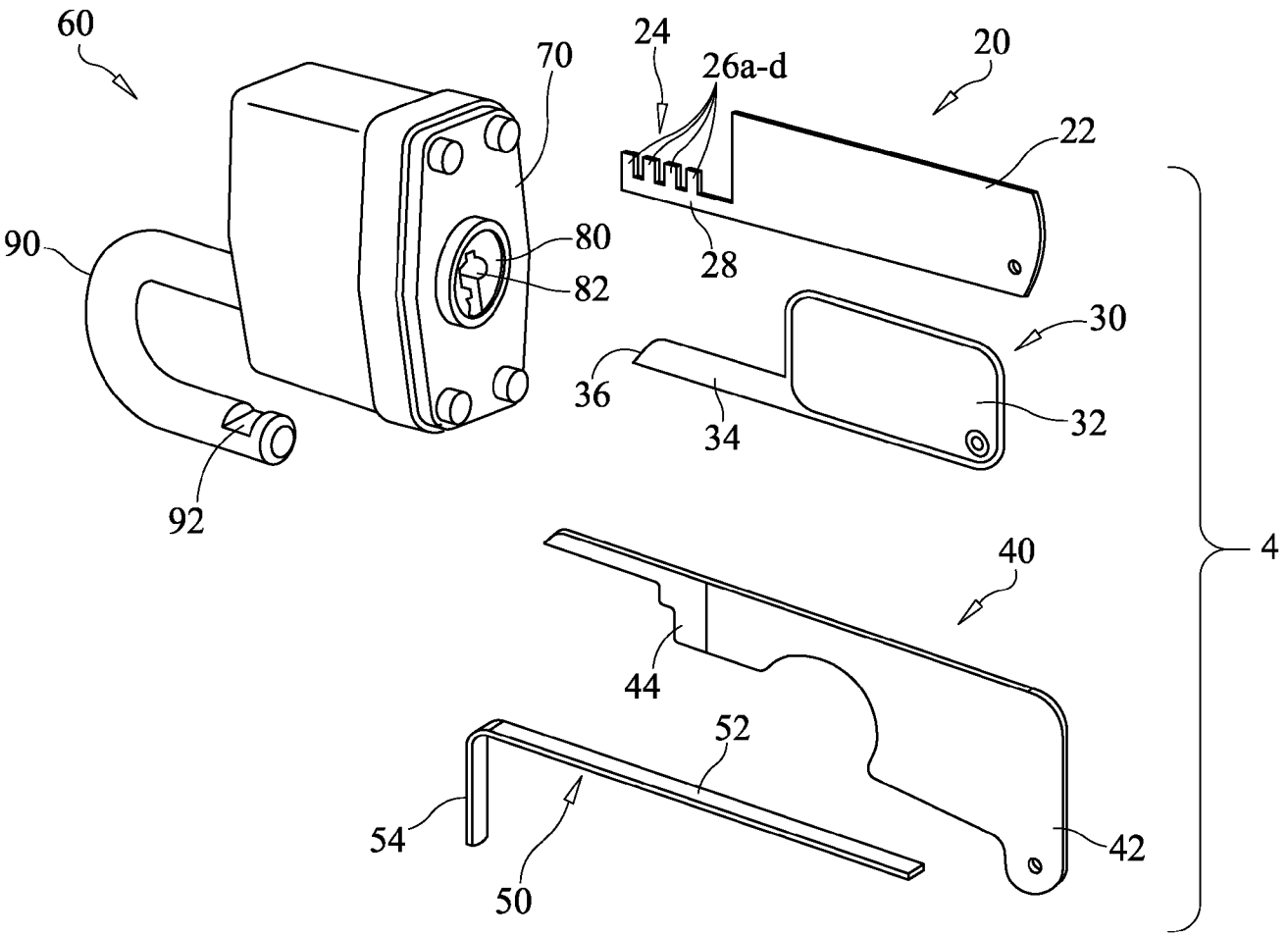
FIG. 7 is a side perspective view of a key, lift device, shim and torque wrench of an alternative embodiment of the pin tumbler lock releasing system of the present invention, the view showing all four instruments distanced from a pin tumbler lock that is in a lock released state.
Figure 8:
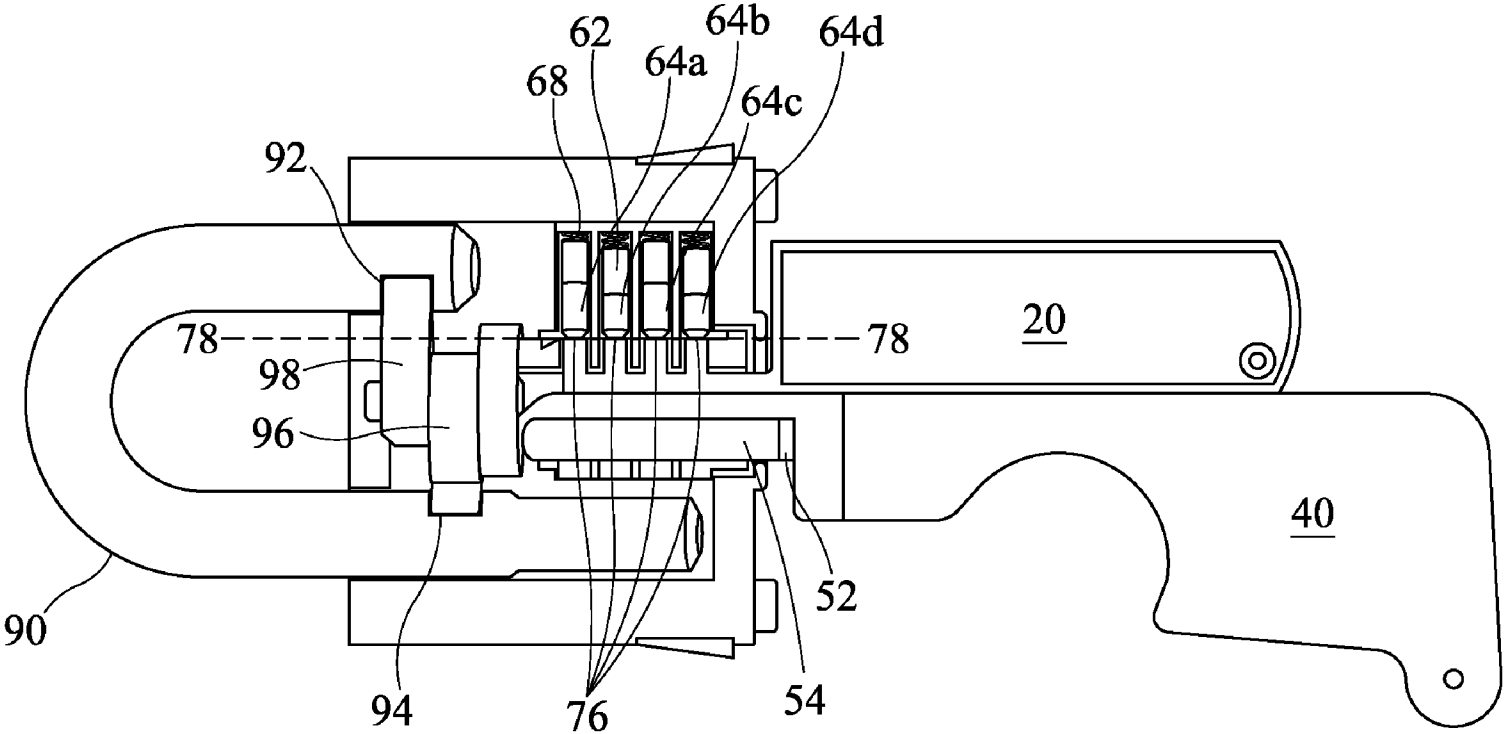
FIG. 8 is a side elevational view of the key and shim of the alternative system, the view showing both instruments fully inserted into the lock, shown in cross-section, while it is in a locked state.
Figure 9:
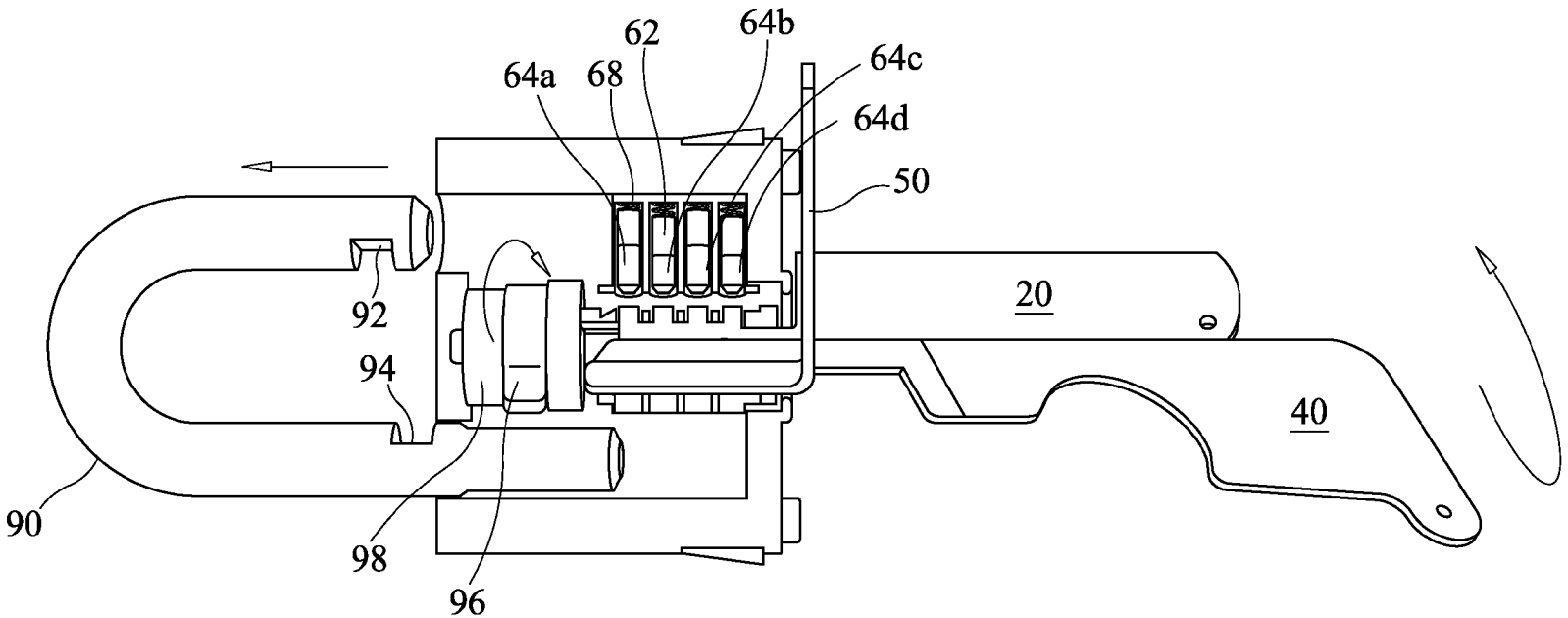
FIG. 9 is a side elevational view of the key and shim of the alternative system, the view showing both instruments fully inserted into the lock and being rotated clockwise, causing the lock, shown in cross-section, to release.

Alternatively, and as illustrated in FIG. 7, the present system 4 may include a fourth piece, in the form a typical torque wrench 50 having a handle portion 52 and insert portion 54, that accompanies a key 20, lift device 30 and shim 40. The use method for this alternative system 4 is executed exactly as that recited above for the preferred three-piece system 2, except that the insert portion 54 of the wrench 50 is inserted into the keyway horizontally adjacent and flush against the shim blade 44 (see FIG. 8) so that the user can simply turn the torque wrench 50 to release the lock 60 as shown in FIG. 9. Typically, the blade portion 44 of a shim device 40 used in this alternative four-piece system 4 will have a shorter vertical profile and a lesser thickness profile than does its counterpart used in the preferred system 2. This dimensioning enables the shim blade 44 to insert below any inward flange that might exist along the keyway 82 and be completely flush against and symmetric with the adjacently inserted portion 54 of the torque wrench 50. Of course, in order to stably cooperate with such a vertically shorter shim blade 44, the height H1 of the key blade base 28 that it supports should be proportionately increased.

It is understood that substitutions and equivalents for and combinations of various elements set forth above may be obvious to those skilled in the art and may not represent a departure from the spirit of the invention. Therefore, the full scope and definition of the present invention is to be set forth by the claims that follow.

What is claimed is:

1. A system for releasing a pin tumbler lock defined by a plug disposed within a casing, a series of aligned vertical holes formed within the plug and casing, spring-loaded driver pins and corresponding key pins disposed within the aligned holes such that the plug can be rotated relative to the casing when respective contact surfaces between the driver pins and key pins are aligned with a shear line between the plug and casing, a locking mechanism that releases upon relative rotation of the plug and casing, and a keyway horizontally formed within the plug, the system comprising:

a lift, device for inserting into the keyway and urging the key pins and driver pins upward against their spring biases, wherein the lift device comprises:

a handle; and a blade configured to insert horizontally into the keyway;

a key device for inserting into the keyway horizontally adjacent the lift device, wherein the key device comprises:

a handle; and a blade comprising a base with teeth projecting therefrom, wherein the key blade is configured to insert horizontally into the keyway, and the key teeth are configured to contact the key pins and to insert vertically into the plug holes;

a shim device for inserting into the keyway underneath the key device and further urging the key pins and driver pins upward against their spring biases such that the key pins and driver pins are disposed outside the plug's periphery and respective contact surfaces between the key teeth and key pins are aligned with the shear line, the shim device comprising:

a handle; and a blade configured to insert horizontally into the keyway; and wherein the plug is rotatable relative to the casing while the key blade and shim blade are horizontally inserted into the keyway and the key teeth are vertically inserted into the plug holes.

2. The system of claim 1, wherein said key blade base has a height H.sub.1, said key teeth each have a height H.sub.2 defined as the distance from the bottom edge of said key blade base to the top edge of a key tooth, said lift blade has a height H.sub.2 and said shim blade has a height H.sub.3, wherein the vertical height of the keyway is approximately equal to H.sub.1 plus H.sub.3, and the vertical distance from the top of the keyway to the shear line is equal to H.sub.2 minus H.sub1.

3. The system of claim 1, wherein said key blade has at least three teeth.

4. The system of claim 1, further comprising a wrench device for inserting into the keyway horizontally adjacent said shim device, wherein the wrench device comprises:

a handle;

an insert portion configured to insert horizontally into the keyway; and wherein the plug is rotatable relative to the casing while the wrench insert portion, said key blade, and said shim blade are inserted horizontally into the keyway and said key teeth are inserted vertically into the plug holes.

5. A system for releasing a pin tumbler lock defined by a plug disposed within a casing, a series of aligned vertical holes formed within the plug and casing, spring-loaded driver pins and corresponding key pins disposed within the aligned holes such that the plug can be rotated relative to the casing when respective contact surfaces between the driver pins and key pins are aligned with a shear line between the plug and casing, a locking mechanism that releases upon relative rotation of the plug and casing, and a keyway horizontally formed within the plug, the system comprising:

a lift element for inserting into the keyway and urging the key pins and driver pins upward against their spring biases;

a key element for inserting into the keyway with the lift element, wherein the key element comprises a blade with teeth projecting therefrom, wherein the key blade is configured to insert horizontally into the keyway, and the key teeth are configured to contact the key pins and to insert vertically into the plug holes;

a shim element for inserting into the keyway underneath the key element and further urging the key pins and driver pins upward against their spring biases such that the key pins and driver pins are disposed outside the plug's periphery and respective contact surfaces between the key teeth and key pins are aligned with the shear line, the shim element comprising a blade configured to insert horizontally into the keyway; and wherein the plug is rotatable relative to the casing while the key blade and shim blade are horizontally inserted into the keyway and the key teeth are vertically inserted into the plug holes.

6. The system of claim 5, wherein said key blade base has a height H.sub.1, said key teeth each have a height H.sub.2 defined as the distance from the bottom edge of said key blade base to the top edge of a key tooth, said lift blade has a height H.sub.2 and said shim blade has a height H.sub.3, wherein the vertical height of the keyway is approximately equal to H.sub.1 plus H.sub.3, and the vertical distance from the top of the keyway to the shear line is equal to H.sub.2 minus H.sub1.

7. The system of claim 5, wherein said key element has at least three teeth.

8. The system of claim 5, further comprising a wrench element configured to insert horizontally into the keyway, wherein the plug is rotatable relative to the casing while the wrench, said key blade, and said shim blade are inserted horizontally into the keyway and said key teeth are inserted vertically into the plug holes.

9. A system for releasing a pin tumbler lock defined by a plug disposed within a casing, a series of aligned vertical holes formed within the plug and casing, spring-loaded driver pins and corresponding key pins disposed within the aligned holes such that the plug can be rotated relative to the casing when respective contact surfaces between the driver pins and key pins are aligned with a shear line between the plug and casing, a locking mechanism that releases upon relative rotation of the plug and casing, and a keyway horizontally formed within the plug, the system comprising:

a key element for inserting into the keyway with the lift element, wherein the key element comprises a blade with teeth projecting therefrom, wherein the key blade is configured to insert horizontally into the keyway, and the key teeth are configured to contact the key pins and to insert vertically into the plug holes;

a shim element for inserting into the keyway underneath the key element and further urging the key pins and driver pins upward against their spring biases such that the key pins and driver pins are disposed outside the plug's periphery and respective contact surfaces between the key teeth and key pins are aligned with the shear line, the shim element comprising a blade configured to insert horizontally into the keyway; and wherein the plug is rotatable relative to the casing while the key blade and shim blade are horizontally inserted into the keyway and the key teeth are vertically inserted into the plug holes.

* * * * *